US010119306B2

(12) United States Patent
Bendel et al.

(10) Patent No.: US 10,119,306 B2
(45) Date of Patent: Nov. 6, 2018

(54) MULTIPLE ENGAGEMENT LOCKING DEVICE

(71) Applicant: Kiekert Aktiengesellschaft, Heiligenhaus (DE)

(72) Inventors: Thorsten Bendel, Oberhausen (DE); Karsten Barth, Hattingen (DE); Hans Deischl, Jettingen (DE); Martin Lindmayer, Sulz a.N. (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 657 days.

(21) Appl. No.: 14/437,035

(22) PCT Filed: Oct. 24, 2013

(86) PCT No.: PCT/DE2013/000630
§ 371 (c)(1),
(2) Date: May 27, 2015

(87) PCT Pub. No.: WO2014/071902
PCT Pub. Date: May 15, 2014

(65) Prior Publication Data

US 2015/0275553 A1 Oct. 1, 2015

(30) Foreign Application Priority Data

Oct. 26, 2012 (DE) ..... 10 2012 020 998

(51) Int. Cl.
*E05C 3/06* (2006.01)
*E05B 79/10* (2014.01)
(Continued)

(52) U.S. Cl.
CPC ..... *E05B 79/10* (2013.01); *E05B 77/32* (2013.01); *E05B 81/06* (2013.01); *E05B 81/16* (2013.01);
(Continued)

(58) Field of Classification Search
CPC ..... Y10S 292/38; E05B 77/32; E05B 79/10; E05B 81/06; E05B 81/32
(Continued)

(56) References Cited

U.S. PATENT DOCUMENTS 3,825,289 A * 7/1974 Armstrong ..... E05B 15/0205 292/163
4,322,958 A * 4/1982 Eigemeier ..... E05B 15/04 292/169
(Continued)

FOREIGN PATENT DOCUMENTS

DE 102007048452 A1 11/2008
WO WO 2004/101925 A1 11/2004

OTHER PUBLICATIONS

Machine Translation of WO2004101925A1 by Lexis Nexis Total Patent on Jun. 24, 2015.
(Continued)

*Primary Examiner* — Carlos Lugo
(74) *Attorney, Agent, or Firm* — Woodard, Emhardt, Moriarty, McNett & Henry LLP

(57) ABSTRACT

The invention relates to a locking device, in particular for a motor vehicle, having a catch mechanism and a coupling device for connecting to a motor drive. The coupling device comprises a coupling lever, which by virtue of a plurality of engagement lugs is able to pivot a coupling lever. The engagement lugs can be detected in succession by the coupling lever and are arranged in this respect one behind the other. The invention further relates to a plastics component for the locking device. An engagement lug is formed by an element protruding from a main face of the coupling lever in order to simplify production and to keep material costs and installation space to a minimum.

20 Claims, 5 Drawing Sheets

(51) Int. Cl.

| | |
|---|---|
| ***E05B 81/06*** | (2014.01) |
| ***E05B 81/16*** | (2014.01) |
| ***E05B 85/00*** | (2014.01) |
| ***E05B 77/32*** | (2014.01) |
| ***E05B 81/34*** | (2014.01) |
| ***E05B 81/32*** | (2014.01) |
| *E05C 3/00* | (2006.01) |

(52) U.S. Cl.
CPC ..... *E05B 81/32* (2013.01); *E05B 81/34* (2013.01); *E05B 85/01* (2013.01); *Y10S 292/38* (2013.01); *Y10T 74/20582* (2015.01); *Y10T 292/108* (2015.04)

(58) Field of Classification Search
USPC ..... 292/194, 201, 216
See application file for complete search history.

(56) References Cited

U.S. PATENT DOCUMENTS 5,615,564 A * 4/1997 Inoue ..... E05B 81/06 292/144
5,634,677 A * 6/1997 Buscher ..... E05B 81/06 292/216
5,833,282 A * 11/1998 Ikeda ..... E05B 81/06 292/144
6,338,508 B1 * 1/2002 Kleefeldt ..... E05B 81/06 292/201
6,428,058 B1 * 8/2002 Graute ..... E05B 85/01 292/201
6,908,137 B2 * 6/2005 Doxey ..... B60N 2/015 292/216
8,328,249 B2 * 12/2012 Corrales ..... E05B 81/14 292/201
8,522,583 B2 * 9/2013 Cumbo ..... E05B 81/06 292/201
9,435,145 B2 * 9/2016 Lujan ..... E05B 77/36
9,822,550 B2 * 11/2017 Fenwick ..... E05B 15/022
2006/0125245 A1 * 6/2006 Graute ..... E05B 81/14 292/216
2006/0131892 A1 * 6/2006 Pereverzev ..... E05B 77/06 292/216
2006/0157989 A1 * 7/2006 Graute ..... E05B 85/243 292/216

OTHER PUBLICATIONS

MachineTranslation of DE102007048452A1 by Lexis Nexis Total Patent on Jun. 24, 2015.

* cited by examiner

MULTIPLE ENGAGEMENT LOCKING DEVICE

CROSS-REFERENCE TO RELATED APPLICATIONS

This application is the U.S. national stage application of International Patent Application No. PCT/DE2013/000630, filed Oct. 24, 2013, which claims priority of German Application No. 10 2012 020 998.3, filed Oct. 26, 2012, which are both hereby incorporated by reference.

BACKGROUND

The present invention relates to a locking device, in particular for a motor vehicle, having a locking mechanism and a coupling device for connecting a motor drive. The coupling drive comprises a coupling lever, which by virtue of a plurality of engagement lugs is able to pivot an actuation lever. The engagement lugs can be detected in succession by the coupling lever and are arranged in this respect one behind the other. The invention further relates to a plastic component for the locking device.

In known motor vehicle door locks the motor drive moves a (central) locking lever into its "locked" or "unlocked" position.

The "unlocking" process can, for instance, be implemented by "Keyless-Entry" systems. In such systems, a motor vehicle user carries an identification device (e.g. a card or a transponder), which when the user approaches the vehicle or actuates the external door actuation (door handle) interacts with a control unit (provided in the vehicle). As part of this interaction, the access authorization of the vehicle user wishing to enter the vehicle is checked. If the user is authorized, the control unit sends out an unlocking system, to at least one motor vehicle door lock. The respective motor vehicle door lock is then unlocked with the aid of the motor drive and can, for instance, be opened with the aid of the external door handle. The unlocking signal can also be generated or transmitted through a radio remote control contained, for instance, in a motor vehicle key This can result in the basic problem that a motor vehicle user already actuates the external door handle whilst the interaction is still ongoing or has not been completed as yet so that the respective motor vehicle door lock has not assumed its "unlocked" position as yet. This can be due to the fact that the known "Keyless-Entry" systems require a certain response time to activate the unlocking.

From practical application, response times of numerous milliseconds are known, which are regarded as too long by vehicle users compared to conventionally designed motor vehicle door locking systems without "Keyless-Entry" systems. Also the situation can arise that the vehicle user has already moved the external door handle in the open position whilst the associated motor vehicle door lock has not as yet assumed its "unlocked" position. In this case, the motor vehicle user must release and activate the external door handle again, perceived as a considerable restriction of comfort.

In order to solve this problem, DE 10 2007 048 452 A1 suggests a locking device comprising a locking mechanism and a motor drive to which a coupling device is connected. The coupling device contains a coupling lever on a first coupling side and a plurality of sequential engagement lugs for the coupling lever on a second opposing side. The engagement lugs are provided in form of a tooth-shaped contour in a slotted hole of an actuation lever. A folded edge of the coupling lever extends into this slotted hole, acting as a latch. The folded edge extends perpendicularly from the main surface of the coupling lever.

Using this locking device it is possible to open a motor vehicle door even when an external door handle has been actuated quickly or early.

SUMMARY

It is the task of the invention to further develop the prior art known from DE 10 2007 048 452 A1 and, in particular, to simplify its manufacture.

In order to solve this task a locking device is provided comprising a locking mechanism and at least one motor drive to which a coupling device is connected, in which the coupling device contains a coupling lever on a first coupling side and a plurality of sequential engagement lugs for the coupling lever on a second opposing side. Such an engagement lug is formed by at least one element extending from a main surface or base area of an actuating lever and generally by an element extending perpendicularly.

The present invention differs from the prior art disclosed in DE 10 2007 048 452 A1 in that an actuating lever contains at least one protruding element in place of a slotted hole in order to provide engagement lugs. As a result, the slotted hole requiring a rather large base area, is no longer needed. The relatively large base area requires a relatively large area of installation and a considerable amount of sheet steel if the actuating lever is made of metal. The coupling lever does, however, not require a folded edge. As a result, the invention requires less installation area and less material and is therefore lighter than the prior art disclosed in DE 10 2007 048 452 A1.

In one embodiment of the invention, the actuating lever is made predominantly of metal. The one or several projecting elements can be provided in a technically simple manner by a folded edge of the sheet steel. As no slotted hole is required no considerable extra amount of material is required.

In one embodiment of the invention, only the actuating lever is predominantly made of metal. At least one protruding element is made of plastic. As a result it is possible to retrospectively provide actuating levers used for other locking devices and generally made of metal for reasons of stability, with engagement lugs in a technically simple manner. Advantageously, a metal base part of an actuating lever suffices that can be used for different lock designs. Where necessary, this is retrospectively equipped with at least one further engagement lug. Surprisingly it has been proven that it is possible to also produce mechanically strong enough engagement lugs from plastic, so that metal does not have to be used in all cases.

The metal base part of the actuating lever preferably contains a folded edge serving as an engagement lug. The metal base part can be used as actuating lever for locks where no second engagement lug is intended. This base part does, in particular, not contain any further engagement lug and/or is designed as a lever. The result is the advantage that the base part is highly modular.

The plastic part providing at least one further engagement lug, is preferably connected to the metal base body by overmoulding, latching and/or by one or several additional retaining elements.

The plastic part providing at least one additional engagement lug extends in one embodiment, when viewed from the top, preferably wave-like and/or in a zigzag fashion in order to improve the mechanical stability in relation to the engagement lug.

The plastic part, providing at least one further engagement lug, encapsulates or surrounds in one embodiment a metal engagement lug in order to improve the mechanical stability of the plastic engagement lug.

In one embodiment the engagement lug first captured by the coupling lever is made of metal. One or several subsequent engagement lugs are made of plastic. As the aforementioned problem of "Keyless-Entry" systems does not always occur, the coupling lever acts comparatively often on the first engagement lug. The subsequent one or several engagement lugs are only required in exceptional situations. Over the life cycle of a lock, this said first engagement lug is therefore most frequently acted upon and is thus advantageously made of metal. In order to reduce, amongst other things the weight, the subsequent one or more engagement lugs acted upon less frequently are made of plastic. As these are acted upon less frequently, they can be produced from a less robust material like plastic without having any adverse effect. All in all, the stability is guaranteed whilst at the same time the weight is kept to a minimum.

In one embodiment of the invention, the coupling lever contains a laterally protruding projection that can engage with the protruding elements of the actuating lever for latching the locking mechanism. This laterally protruding projection is therefore arranged on the same plane as the base surface of the coupling lever. The embodiment allows the use of a small coupling lever advantageously only requiring a small installation space and being of low weight.

DETAILED DESCRIPTION OF THE DRAWINGS

Figure 1:
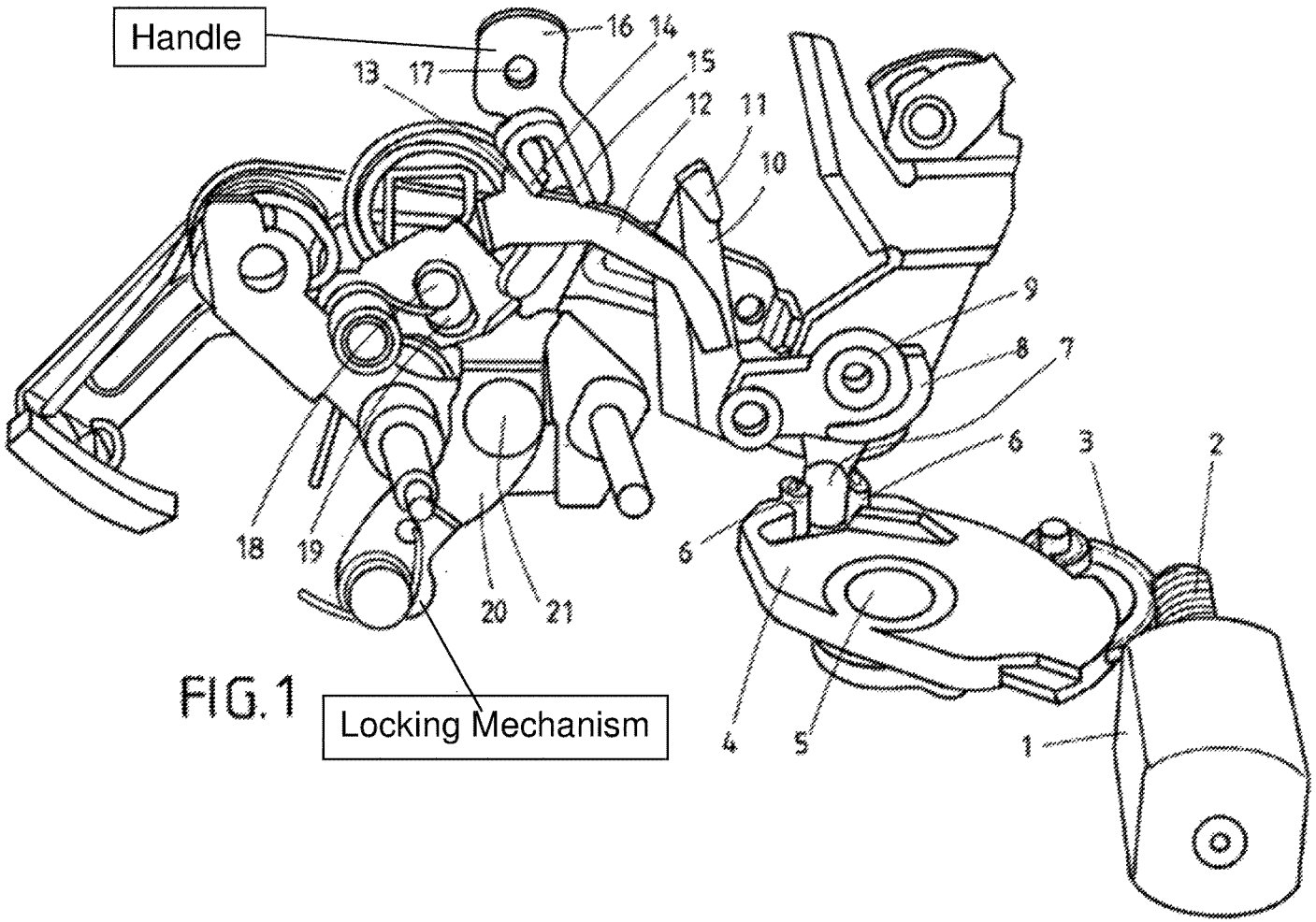
FIG. 1 section of a locking device in a first position.

FIG. 1 shows an electric motor 1 that can drive a gear wheel 3 by means of a worm gear 2. The gear wheel 3 is part of a gear unit, used for pivoting a disk-like element 4 around an axis 5. The disk-like element 4 contains two elements 6 protruding from its main surface and engaging an arm 7 of a lever 8 and that are able to pivot said arm. As a result, the motor 1 can pivot the lever 8 around its axis 9. The lever 8 contains a further arm 10 with an element 11 projecting perpendicularly therefrom. By pivoting the lever 8, a coupling lever 12 can be pivoted by means of the projecting element 11. Pivoting coupling lever 12 in this way moves lever 20 which is operatively connected to the illustrated locking mechanism.

The partially circular coupling element 12, which is particularly space saving and light, contains a laterally protruding projection 13, which depending on the position of the coupling lever can engage with two successive engagement lugs 14 and 15 of an external and internal actuating lever 16. Where the lateral projection 13 engages with one of the two engagement lugs 14 or 15, movement of actuating lever 16 moves lever 20 thereby unlatching the locking mechanism. The two engagement lugs 14 and 15 protrude perpendicularly from the actuating lever 16.

The axis 18 of the coupling lever 12 extends into a slotted hole 19 of a lever 20. The coupling lever 12 can be pivoted around an axis 18. Where starting from the position shown in FIG. 2, the coupling lever 12 is pivoted in clockwise direction by means of lever 8, the lateral projection 13 does no longer engage with the engagement lug 14 or 15. Unlatching of the locking mechanism by actuation of a handle or of the external or internal actuating lever 16 of a respective motor vehicle door or flap is then no longer possible. The respective vehicle door or vehicle flap is then locked.

When the lever 20 is pivoted around its axis 21 in clockwise direction by actuation of the actuating lever 16 or of a handle connected therewith, the coupling lever 12 acts as a bridging element between the actuating lever 16 and the lever 20. With the aid of lever 20, the locking mechanism can be directly or indirectly released.

Figure 2:
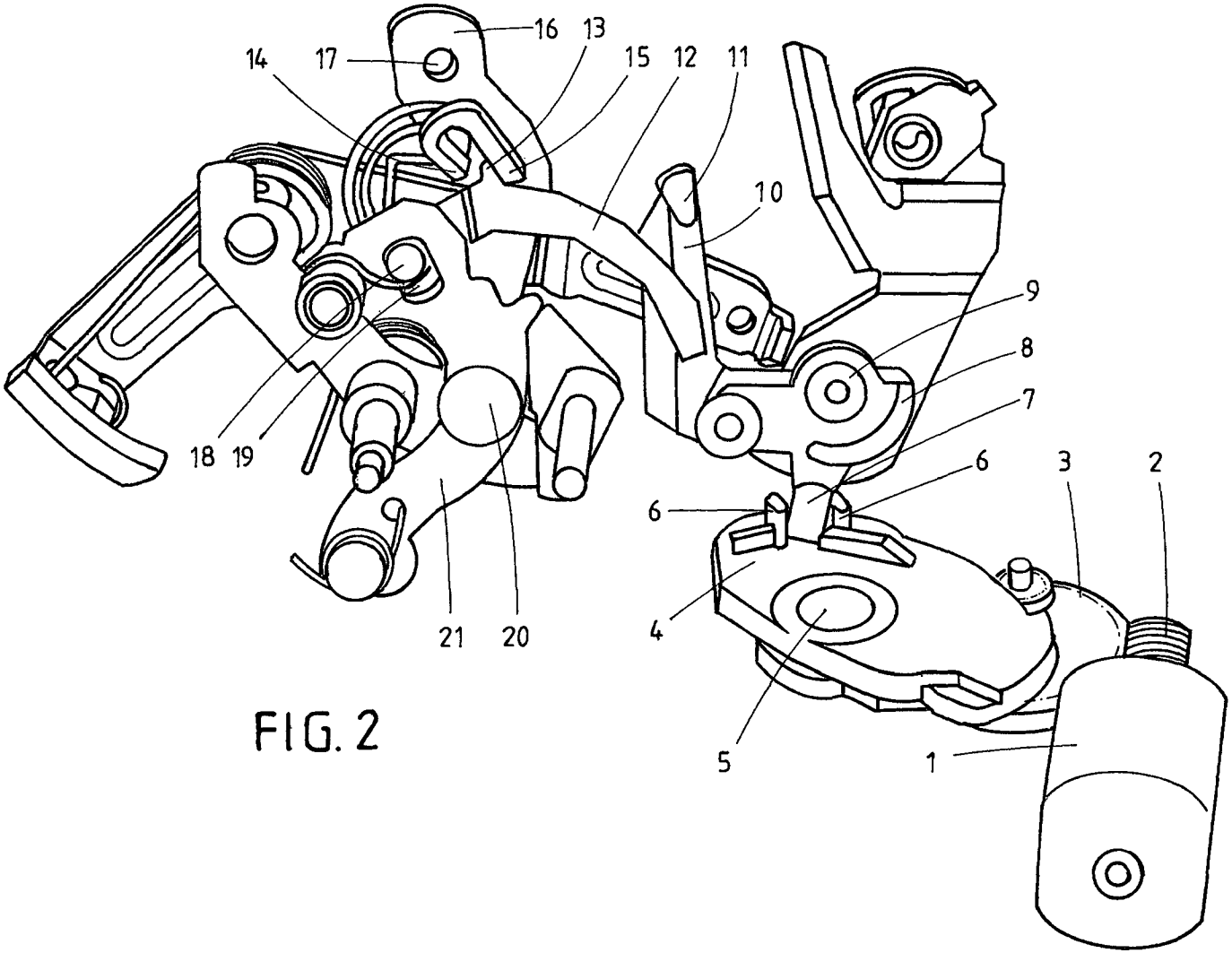
FIG. 2 section of a locking device in a second position.

In the embodiment shown in FIGS. 1 and 2, the actuating lever 16 is made entirely of metal. The engagement lugs 14 and 15 are formed by a bracket which is, for instance, connected to the main surface of the actuating lever 16 by welding. Preferably, such a bracket is connected to the actuating lever to form a single component. Production is particularly simple by suitable cutting, folding and bending. With the aid of this U-shaped bracket, with one leg of the U-shaped form being longer than the other leg, the two engagement lugs 14 and 15 are provided by a projecting element in the sense of the invention.

Figure 3:
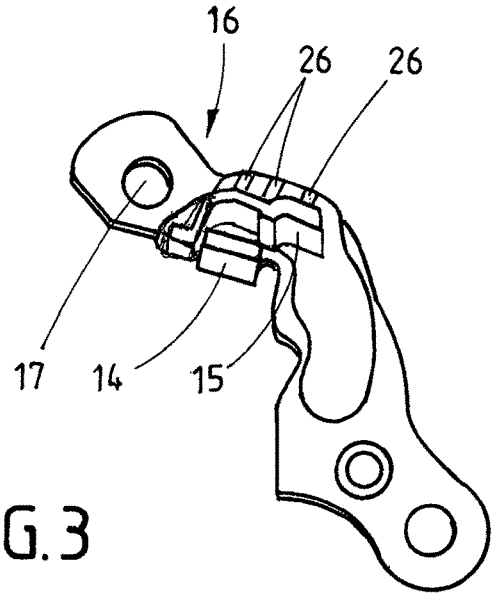
FIG. 3 two-part embodiment of an actuating lever with overmoulded plastic
Figure 4:
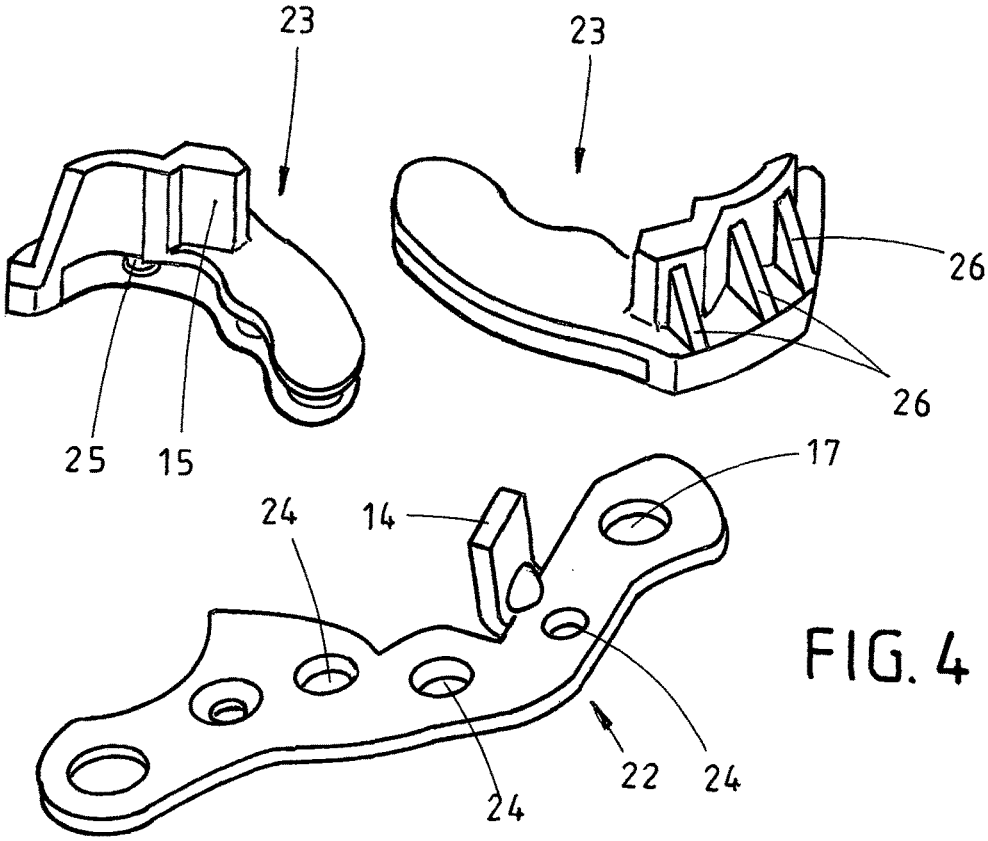
FIG. 4 individual parts of an actuating lever shown in FIG. 3.

FIG. 3 shows a two-part embodiment of the actuating lever 16. FIG. 4 shows the two individual parts of the actuating lever 16 of FIG. 3. The actuating lever 16 contains a metal base body 22 with a first engagement lug 14 and an overmoulded plastic part 23 to provide a second engagement lug 15 that is less acted upon as it is arranged behind the engagement lug 14.

In order to ensure good mechanical stability, the protruding element with the engagement lug 15 has a wave or zigzag shape when viewed from above.

In order to provide a modular concept, the metal base body 22 including its metal engagement lug 14 can also without the injection moulded part, be used as an actuating lever for locks not containing a second engagement lug.

In order to reliably connect the plastic part 23 to the metal base body 22, the base body 22 contains one or several through holes 24 through which in the injection moulded state webs 25 of the plastic part 23 extend. Alternatively or in addition, a lateral contour of the metal base body 22 can also be overmoulded with plastic, in order to contribute to a reliable hold.

The metal base body 22 contains a folded edge through which the metal engagement lug 14 is provided. Preferably, the plastic part contains one or several support webs 26, mechanically stabilizing the engagement lug 15.

Figure 5:
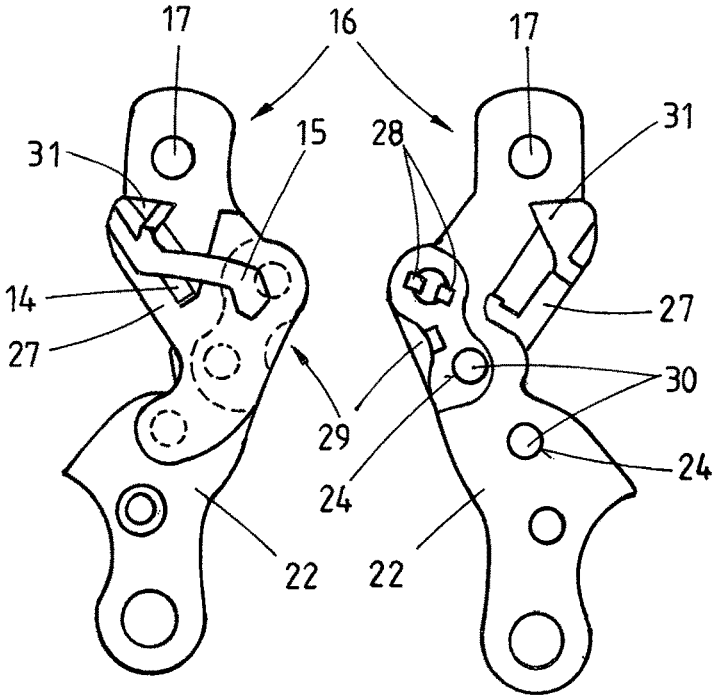
FIG. 5 two-part embodiment of an actuating lever with a latched plastic part, FIG. 6 individual parts of an actuating lever shown in FIG. 5, FIG. 7 single-part actuating lever.
Figure 6:
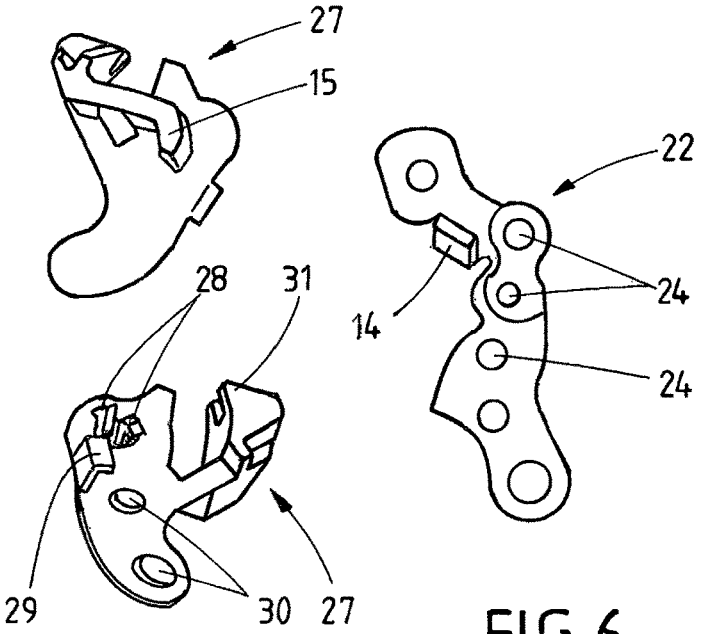

FIG. 5 shows a further embodiment of a two-part actuating lever 16. FIG. 6 shows the two individual parts of the actuating lever 16 shown in FIG. 5. The actuating lever 16 in turn contains a metal base body 22 with a first engagement lug 14, as already shown in FIGS. 3 and 4. Furthermore, a plastic part 27 is provided, through which a second, rear engagement lug 15 can be added to the metal base body. The plastic part 27 is or is already positively connected to the metal base body 22 and preferably contains for this purpose one or several and, in particular, two detent elements 28 as well as preferably also an interlocking element 29 protruding from the base area or main surface. The two elastically designed detent elements 28 can be engaged in a hole of the metal base body for connection, as shown in the drawings of FIGS. 5 and 6. The interlocking element 29 can enclose a lateral contour of the metal base body 22 to thus improve the hold.

Furthermore, one embodiment provides alternatively or in addition several protruding pins 30, preferably having a ramp shape at their free end. The one or several pins 30 are arranged in such a way that in the connected state they extend into holes 24 of this metal base part. This provides a better hold.

The ramp shape of the pins 30 supports the subsequent connection of the parts: First the two detent elements 28 are latched in the provided hole 24 and in such a way that the interlocking element 29 is positioned at a gap to the lateral contour of the metal base body 22. The detent elements 28 then serve as an axis around which the plastic part 23 is pivoted into its position shown in FIG. 5. The shown ramp shape of the pins 30 facilitates this pivoting, making assembly easier. The incline of the ramp shape is arranged accordingly.

Alternatively or in addition, one embodiment contains a fork-like interlocking element 31, which in its connected state encloses a lateral contour of the metal base body 22. This provides a better hold.

Preferably, the fork-like interlocking element 31 is arranged in such a way that it can be connected as described by latching and subsequent pivoting.

In order to ensure a good mechanical stability, the protruding element with the engagement lug 15 has a wave or zigzag shape when viewed from the top. Preferably the protruding element surrounds and/or encloses the metal engagement lug 14 as shown, in order to further better ensure the stability of the engagement lugs 15.

Figure 7:
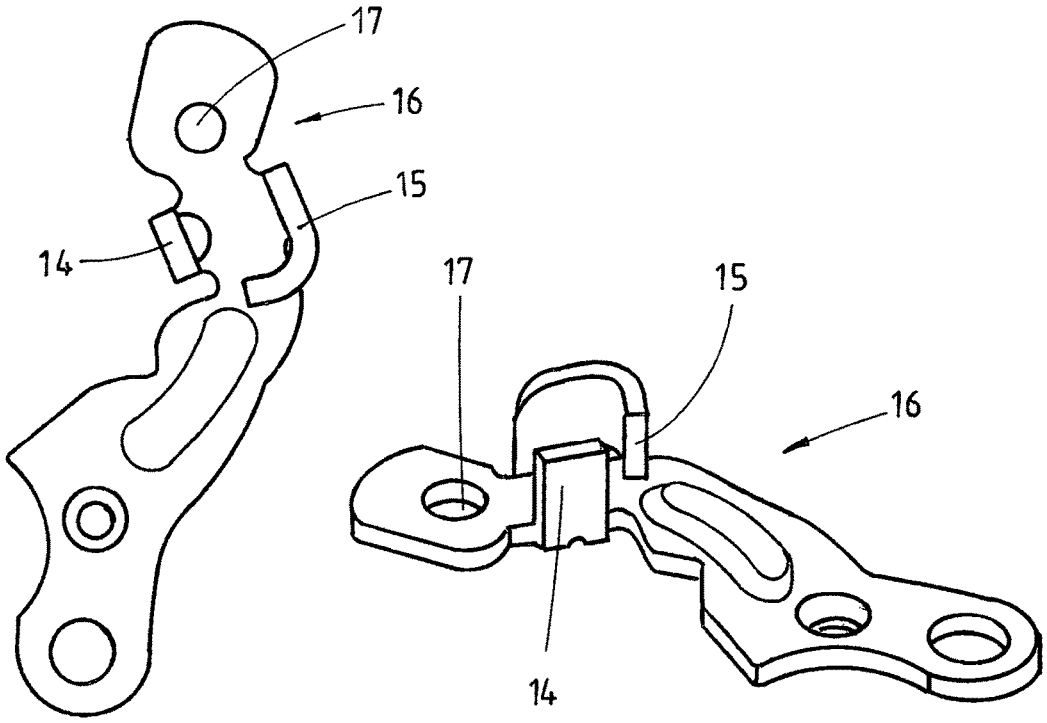

FIG. 7 shows a single-part embodiment of an actuating lever 16, generally made from metal. The two engagement lugs 14 and 15 are a folded edge, allowing particularly easy production. The rear folded edge 15 is also provided by final bending.

LIST OF REFERENCE NUMERALS

1: Electric motor
2: Worm gear
3: Gear wheel
4: Pivotable disk
5: Axis
6: Protruding element
7: Lever arm
8: Lever
9: Axis:
10: Lever arm
11: Protruding element
12: Coupling lever
13: Projection
14: First engagement lug
15: Second engagement lug
16: Actuating lever
17: Axis
18: Axis
19: Slotted hole
20: Lever:
21: Axis
22: Metal base body
23: Plastic component
24: Hole
25: Web
26: Support web
27: Plastic component
28: Latching element
29: Protruding interlocking element
30: Protruding pin
31: Fork-shaped interlocking element

The invention claimed is:

1. A locking device for a motor vehicle, the locking device comprising:

a locking mechanism, a motor drive, an actuating lever comprising a pair of engagement lugs arranged in succession, wherein the actuating lever is operatively coupled to a handle, an unlocking lever operatively connected to the locking mechanism, wherein the unlocking lever defines a slotted hole, a coupling lever which includes a pin positioned in the slotted hole of the unlocking lever such that movement of the coupling lever moves the unlocking lever, wherein the coupling lever is, in an "unlocked state", operatively coupled to the actuating lever by the pair of engagement lugs such that movement of the actuating lever moves the coupling lever and is, in an "locked state", operatively decoupled from the actuating lever and wherein the coupling lever is operatively coupled to the motor drive such that actuation of the motor drive moves the coupling lever, for shifting between the "unlocked state" and the "locked state", wherein each of such engagement lugs are formed by an element projecting from the base area of the actuating lever.

2. The locking device of claim 1, wherein at least one engagement lug is made of plastic.

3. The locking device of claim 2, wherein the actuating lever comprises a metal lever-shaped base part having a first engagement lug of the plurality of engagement lugs.

4. The locking device of claim 3, wherein the first engagement lug is a plastic component connected to the actuating lever in a manner selected from the group consisting of: overmoulding, latching using one or several latching elements, one or several interlocking elements, and or several pins.

5. The locking device of claim 4, wherein the plastic component has a wave or zigzag shape when viewed from the top.

6. The locking device of claim 5, wherein the plastic component surrounds and/or encloses a metal engagement lug.

7. The locking device of claim 6, wherein the coupling lever is partly circular.

8. The locking device of claim 6, wherein the coupling lever contains a lateral protruding projection that can engage the engagement lugs of the actuating lever.

9. The locking device of claim 1, wherein at least one of the engagement lugs are connected to the actuating lever to form a single part in such a way that they can be produced by edge folding.

10. A plastic component for use with the locking device of claim 1 that provides at least one of the engagement lugs, the plastic component containing one or several latching elements with one or several interlocking elements and/or one or more pins that mechanically connects the plastic component to the actuating lever.

11. The plastic component of claim 10, wherein the plastic component has a wave or zigzag shape that provides at least one of the engagement lugs.

12. The locking device of claim 1, wherein the actuating lever comprises a metal lever-shaped base part having an engagement lug.

13. The locking device of claim 1, wherein the coupling lever is partly circular.

14. The locking device of claim 1, wherein the coupling lever contains a lateral protruding projection that can engage the engagement lugs of the actuating lever.

15. The locking device of claim 1, further comprising a drive lever that operatively connects the motor drive to the coupling lever.

16. The locking device of claim 15, further comprising a disk that operatively connects the motor drive to the drive lever.

17. The locking device of claim 1, wherein the pin and slotted hole connection between the unlocking lever and the coupling lever permits movement of the coupling lever without moving the unlocking lever.

18. A locking device comprising:

a locking mechanism, a motor drive, an actuating lever comprising a pair of engagement lugs arranged in succession, wherein the actuating lever is operatively coupled to a handle, an unlocking lever operatively connected to the locking mechanism, wherein the unlocking lever defines a slotted hole, a coupling lever which includes a pin positioned in the slotted hole of the unlocking lever so that movement of the coupling lever moves the unlocking lever, wherein the coupling lever is, in an "unlocked state", operatively coupled to the actuating lever by the pair of engagement lugs such that movement of the actuating lever moves the coupling lever and is, in an "locked state", operatively decoupled from the actuating lever and wherein the coupling lever is operatively coupled to the motor drive such that actuation of the motor drive moves the coupling lever, for shifting between the "unlocked state" and the "locked state", wherein at least one of the engagement lugs includes a plastic component connected to the actuating lever in a manner selected from the group consisting of: overmoulding, latching using one or several latching elements, one or several interlocking elements, and one or several pins engagement;

wherein at least one of the engagement lugs is made of metal with the plastic component surrounding and/or enclosing at least one of the metal engagement lugs; and wherein the coupling lever is partly circular and contains a lateral protruding projection that can engage the engagement lugs of the actuating lever.

19. The locking device of claim 18, wherein the plastic component has a wave or zigzag shape when viewed from the top.

20. The locking device of claim 18, wherein the pin and slotted hole connection between the unlocking lever and the coupling lever permits movement of the coupling lever without moving the unlocking lever.

* * * * *